US005318183A

United States Patent [19]

Cohen et al.

[11] Patent Number: 5,318,183

[45] Date of Patent: Jun. 7, 1994

[54] BOTTLE WITH INSERT TO REDUCE EFFECTIVE VOLUME

[75] Inventors: Donald B. Cohen, Raleigh, N.C.; Norris W. Matthews, Stowe, Pa.

[73] Assignee: Glaxo, Inc., Research Triangle Park, N.C.

[21] Appl. No.: 972,069

[22] Filed: Nov. 4, 1992

Related U.S. Application Data

[63] Continuation of Ser. No. 762,184, Sep. 19, 1991, abandoned.

[51] Int. Cl.[5] ..... B65D 83/04; B65D 77/04

[52] U.S. Cl. ..... 206/538; 215/6; 206/528; 206/540

[58] Field of Search ..... 206/528, 538, 540; 215/6

[56] References Cited

U.S. PATENT DOCUMENTS

| | | | |
|---|---|---|---|
| 2,072,630 | 3/1937 | Ferry | 215/6 |
| 2,086,073 | 7/1937 | Francescon . | |
| 2,321,998 | 6/1943 | Crouch et al. . | |
| 2,941,689 | 6/1960 | Black . | |
| 3,163,544 | 12/1964 | Valyi . | |
| 3,367,484 | 2/1968 | Nelson . | |
| 3,458,076 | 7/1969 | Babcock . | |
| 3,715,189 | 2/1973 | Nighohossian et al. . | |
| 4,460,090 | 7/1984 | Paoletti | 206/528 |
| 4,618,444 | 10/1986 | Hudson et al. . | |
| 4,636,328 | 1/1987 | Flynn et al. . | |
| 4,666,062 | 5/1987 | Pershall . | |
| 4,776,972 | 10/1988 | Barrett . | |
| 5,056,681 | 10/1991 | Howes | 215/6 X |
| 5,099,998 | 3/1992 | Curzon et al. | 220/258 X |
| 5,197,602 | 3/1993 | Biesecker et al. | 215/6 X |

FOREIGN PATENT DOCUMENTS

| | | | |
|---|---|---|---|
| 447803 | 7/1927 | Fed. Rep. of Germany | 215/6 |
| 1445637 | 6/1966 | France | 206/540 |

*Primary Examiner*—William I. Price

*Attorney, Agent, or Firm*—David J. Levy; Charles T. Joyner

[57] ABSTRACT

A bottle having an inserted tube in its neck to effectively reduce its interior volume and allow a large surface area for the bottle exterior, e.g. for supporting a large label or to allow oversized print, with a relatively small interior volume, e.g. to prevent abrasions caused by the interior contents moving excessively against each other.

9 Claims, 2 Drawing Sheets

BOTTLE WITH INSERT TO REDUCE EFFECTIVE VOLUME

This application is a continuation of application Ser. No. 07/762,184, filed Sep. 19, 1991 now abandoned.

BACKGROUND OF THE INVENTION

Various devices have been proposed based on "bottle within a bottle" arrangement for the purpose of carrying two materials which either communicate with each other or remain separate. Thus, U.S. Pat. No. 2,086,073 teaches a whiskey bottle having a glass test tube through its neck and into its interior. The tube has several apertures and holds charcoal cubes. This allows the whiskey to "age" in a glass bottle by having it wash through the tube and come into contact with the charcoal. The glass tube is secured by having a lip which seats on a gasket around the mouth of the bottle and is further secured by a sealing disc on top of it which is pressed down by the bottle cap when it is screwed on. The test tube must be removed when one wants to remove the whiskey and is discarded leaving the bottle contents in the bottle without charcoal sediment.

In summary, the bottle of U.S. Pat. No. 2,086,073 has 2 compartments with material in both, which contents communicate with each other and where the contents of the smaller compartments are discarded to remove those from the larger.

U.S. Pat. No. 3,367,484 teaches a container for medications such as tablets where the main tablet compartment is supplemented by an auxiliary transparent compartment which remains closed and which holds one or more of such tablets. When the patient returns the empty container to the pharmacist for a refill, the remaining tablet in the auxiliary compartment is visible to allow identification of the prescription. Thus, the contents of two compartments do not communicate with each other and only the contents of the larger compartment can be removed.

An object of this invention is a system to hold pharmaceutical solids such as tablets which allows normal sized labels to be applied and yet obviates the need for fillers such as cotton to reduce empty volume.

SUMMARY OF THE INVENTION

A bottle such as to hold tablets is provided for presenting a suitably large exterior surface area while maintaining a precise and limited interior volume. The large exterior allows application of standard labels, e.g. pharmacist's labels, while the smaller interior volume allows packing of a given number of tablets up to the top of the bottle.

DETAILED DESCRIPTION OF THE INVENTION

The container of the invention allows a large exterior surface area so as to present a surface for a standard label used by a pharmacist, while at the same time having a relatively small effective interior volume so that a particular number of tablets fills up the available space. This has the advantage of preventing breakage during shipment caused by the tablets or capsules moving about their allotted space excessively and avoids the use of the familiar cotton ball at the top of a pharmaceutical bottle, also known as a "coiler".

Figure 1:
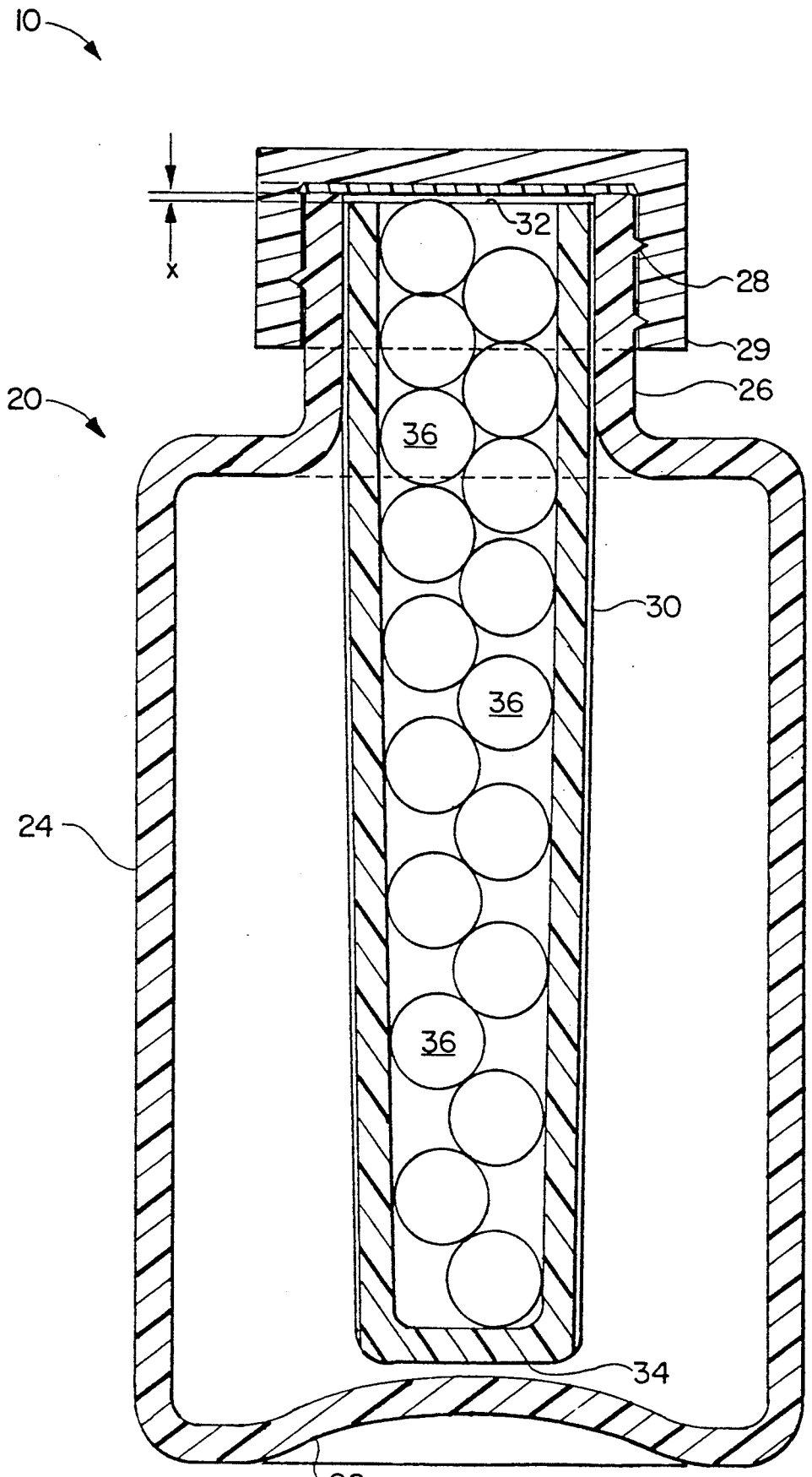
FIG. 1 depicts a container 10 according to the invention with an outer bottle 20 and an interior tube 30.

FIG. 1 shows a vertical cross sectional view of container 10 of the invention comprising a bottle 20 made of a suitable material such as injection molded polyethylene. The bottle 20 comprises a bottom plate 22, which may be raised at the center, sidewalls 24, a round neck 26 carrying threads 28 and a cap 29 which engages threads 28. Other closure devices include snap-on lids. Within neck 26 is inserted interior cylinder or tube 30 composed preferably of the same plastic, e.g. polyethylene, as bottle 20. Tube 30 has an open end 32 and a closed end 34. To avoid difficulty in closing cap 29 because a particular batch of tubes 30 is too long even though it is measured to meet exactly the top of neck 26, tube 30 is preferably slightly shorter than the length of bottle 20 from the top of neck 26 to the interior surface of bottom plate 22. Thus, the distance "x" in FIG. 1 may be about 1 to 2 millimeters. Within tube 30 are tablets 36.

Figure 2:
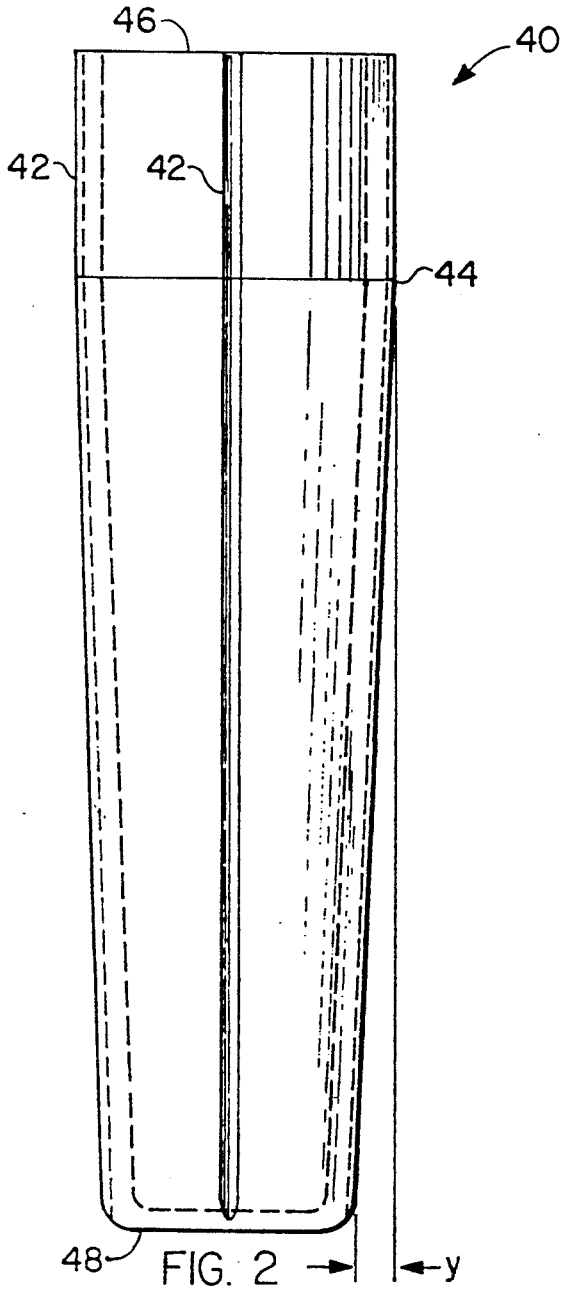
FIG. 2 shows an interior tube 40 with particular details.

FIG. 2 depicts a particular tube 40 for use in the invention. Tube 40 may have at least 1 and preferably 4 longitudinal grooves 42 about ½ to 1 millimeter in depth which aid in assembling the container. When tube 40 is inserted into bottle 20, the extra volume of air which must be displaced can move out of the bottle via the grooves to allow a high speed insertion process. A further feature is shown exaggerated in FIG. 2 as a tapering down of the tube from a point near the open end 46 of tube 40 to the closed end 48. The tapering distance "y" may be about 1–2 millimeters. This tapering also allows a rapid insertion to take place. Finally, the portion of the tube 40 near the open end 46 is not tapered so that a firm friction fit can be made between the inside of the neck 26 and outside of the tube 40. Alternatively, the tube can be glued or heated to partially melt it into place. Preferably, tube 40 has no apertures, resulting in isolation of its contents from the interior portion of bottle 20 which is not occupied by the tube.

An alternative embodiment of tube 40 is where there are no grooves and instead, one or more holes through the cylinder wall which are smaller than tablets 36. When inserted into the bottle, the air displaced by the tube can exit through the hole. A plurality of holes can be used as in a "nest" meshwork although the preferred arrangement is the solid tube.

Figure 2A:
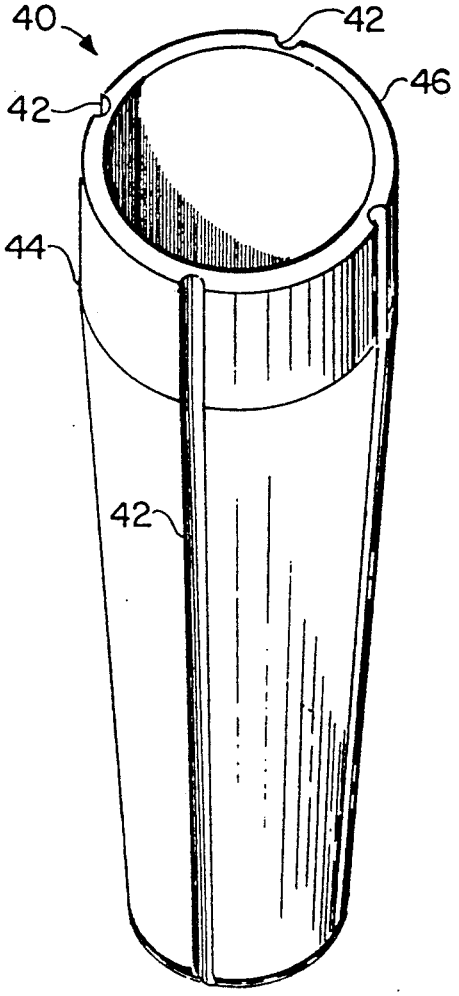
FIG. 2*a* shows a top perspective view of interior tube 40.
Figure 2B:
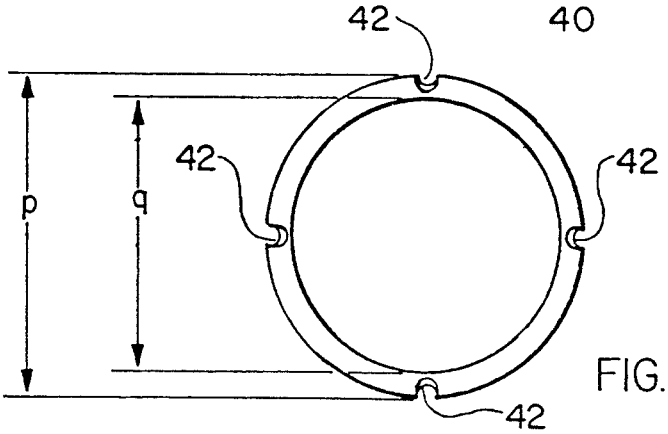
FIG. 2*b* shows a bottom plan view of interior tube 40.

FIG. 2*a* shows a top perspective view of the tube 40 with grooves 42. FIG. 2*b* shows a bottom plan view of tube 40 with the larger diameter p shown as would exist at point 44 compared to the smaller diameter q as would exist at the closed end of 48 of tube 40.

Materials with which to form bottle 20 and tube 30 according to the invention are plastics such as low density polyethylene, high density polyethylene or polypropylene and which are sold by Drug Plastics and Glass Company Inc. of Boyertown, Pa.

A particular aspect of the invention provides for the interior volume of the bottle to be at least twice that of the tube.

What is claimed is:

1. A container for holding discrete solids which comprises an outer bottle having a bottom plate, sidewalls, a round neck and a cap which can be secured and removed from said neck, and disposed through and inside said neck and secured to the inside of said neck, a cylindrical rigid tube having solid walls with apertures, at least 1 groove therein extending longitudinally along the outer surface thereof, a closed end and an open end, which is approximately coincident with the top of said neck, said tube slightly tapering from a maximum circumference at a point near the open end to a lesser circumference at the closed end.

2. The container of claim 1, wherein the height of said cylindrical tube is the same or slightly less than the distance from the inside surface of the bottom plate to the top of the neck.

3. The container of claim 2, wherein the height of said cylindrical tube is slightly less than the distance from the inside surface of the bottom of the plate to the top of the neck.

4. The container of claim 1, wherein the outside circumference of said cylindrical tube is approximately the same as the inside circumference of said neck.

5. The container of claim 1, wherein the cylindrical tube is secured to the outer bottle by being friction fit into said neck.

6. The container of claim 1, wherein the interior volume of said outer bottle is at least about twice the interior volume of said cylindrical tube.

7. A pharmaceutical container for tablets or capsules which comprises an outer bottle having a bottom plate, sidewalls, a round neck and a cap which can be secured and removed from said neck, and disposed through and inside said neck and secured to the inside of said neck, a cylindrical rigid tube having solid walls without apertures, at least 1 groove therein extending longitudinally along the outer surface thereof, a closed end and an open end, which is approximately coincident with the top of said neck, said tube slightly tapering from a maximum circumference at a point near the open end to lesser circumference at the closed end and disposed within said cylindrical tube, a plurality of tablets or capsules.

8. A method for reducing the effective volume of a bottle, which comprises an outer bottle having a bottom plate, sidewalls, a round neck and a cap which can be secured and removed from said neck, which method comprises disposing through and inside said neck and securing to the inside said neck, a cylindrical rigid tube having solid walls without apertures, at least 1 groove therein extending longitudinally along the outer surface thereof, a closed end and an open end, which open end is approximately coincident with the top of said neck, said tube slightly tapering from a maximum circumference at a point near the open end to a lesser circumference at the closed end.

9. The method of claim 8, wherein the interior volume of said bottle is at least about twice the interior volume of said cylinder.

* * * * *